US007035374B2

(12) United States Patent
Chen

(10) Patent No.: US 7,035,374 B2
(45) Date of Patent: Apr. 25, 2006

(54) OPTICAL DEVICE FOR DIRECTING X-RAYS HAVING A PLURALITY OF OPTICAL CRYSTALS

(75) Inventor: Zewu Chen, Schenectady, NY (US)

(73) Assignee: X-Ray Optical Systems, Inc., East Greenbush, NY (US)

( * ) Notice: Subject to any disclaimer, the term of this patent is extended or adjusted under 35 U.S.C. 154(b) by 0 days.

(21) Appl. No.: 11/048,146

(22) Filed: Feb. 1, 2005

(65) Prior Publication Data

US 2005/0201517 A1 Sep. 15, 2005

Related U.S. Application Data

(63) Continuation of application No. PCT/US03/023412, filed on Jul. 25, 2003.

(60) Provisional application No. 60/400,809, filed on Aug. 2, 2002.

(51) Int. Cl.
*G21K 1/06* (2006.01)

(52) U.S. Cl. ..... 378/84; 378/85

(58) Field of Classification Search ..... 378/45, 378/70, 71, 81–85, 145
See application file for complete search history.

(56) References Cited

U.S. PATENT DOCUMENTS 3,927,319 A * 12/1975 Wittry ..... 378/85
4,649,557 A * 3/1987 Hornstra et al. ..... 378/84
5,127,028 A * 6/1992 Wittry ..... 378/84
5,315,113 A * 5/1994 Larson et al. ..... 250/305
5,787,146 A 7/1998 Giebeler ..... 378/82
5,790,628 A * 8/1998 Ishida ..... 378/83

(Continued)

OTHER PUBLICATIONS

Copy of International Search Report (Form PCT/ISA 210), dated Jun. 2, 2004, of PCT Application No. PCT/US03/23412 (Publication No. WO 2004/013867 A2, Published Feb. 12, 2004) 4 pps.

(Continued)

*Primary Examiner*—Edward J. Glick
*Assistant Examiner*—Irakli Kiknadze
(74) *Attorney, Agent, or Firm*—Jeffrey R. Klembczyk, Esq.; Kevin P. Radigan, Esq.; Heslin Rothenberg Farley & Mesiti, P.C.

(57) ABSTRACT

Devices for improving the capturing and utilization of high-energy electromagnetic radiation, for example, x-rays, gamma rays, and neutrons, for use in physical, medical, and industrial analysis and control applications are disclosed. The devices include optics having a plurality of optical crystals, for example, doubly-curved silicon or germanium crystals, arranged to optimize the capture and redirection of divergent radiation via Bragg diffraction. In one aspect, a plurality of optic crystals having varying atomic diffraction plane orientations are used to capture and focus divergent x-rays upon a target. In another aspect, a two- or three-dimensional matrix of crystals is positioned relative to an x-ray source to capture and focus divergent x-rays in three dimensions.

27 Claims, 10 Drawing Sheets

U.S. PATENT DOCUMENTS

| | | | | |
|---|---|---|---|---|
| 6,233,096 | B1 * | 5/2001 | Marcelli et al. | 359/574 |
| 6,285,506 | B1 * | 9/2001 | Chen | 359/642 |
| 6,317,483 | B1 * | 11/2001 | Chen | 378/84 |
| 2003/0142786 | A1 * | 7/2003 | Houge | 378/84 |

OTHER PUBLICATIONS

Hastings, J.B., et al., "Local-Structure Determination at High Dilution: Internal Oxidation of 75-ppm Fe in Cu," Physical Review Letters, vol. 43, No. 24, pps. 1807-1810 (Dec. 10, 1979).

Jonansson, T., "Über ein neuartiges, genau fokussierendes Röntgenspektrometer," Zeitschrift Für Physik, vol. 82, pps. 507-528 (Feb. 1, 1933).

Guinier, A., et al., "Rayons-X—Sur les Monochromateurs a Cristal Courbe," Comptes Rendus Hebdomadaires Des Seances De L'Academie Des Sciences, Gauthier-Villars, Paris, France, vol. 223, pps. 31-32 (Jul. 1, 1946).

* cited by examiner

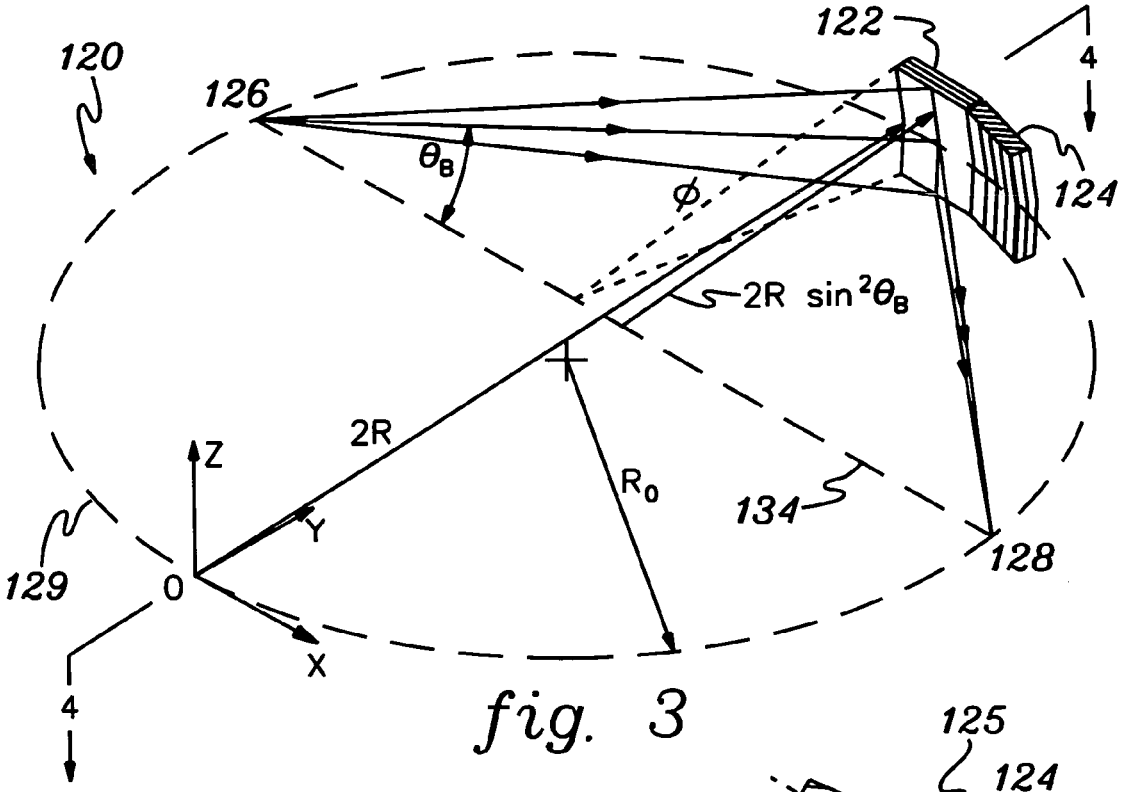
fig. 3
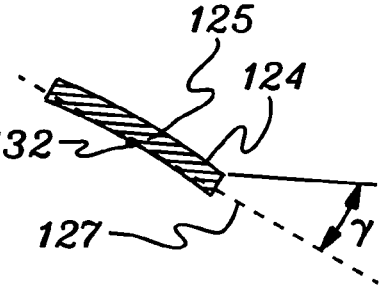
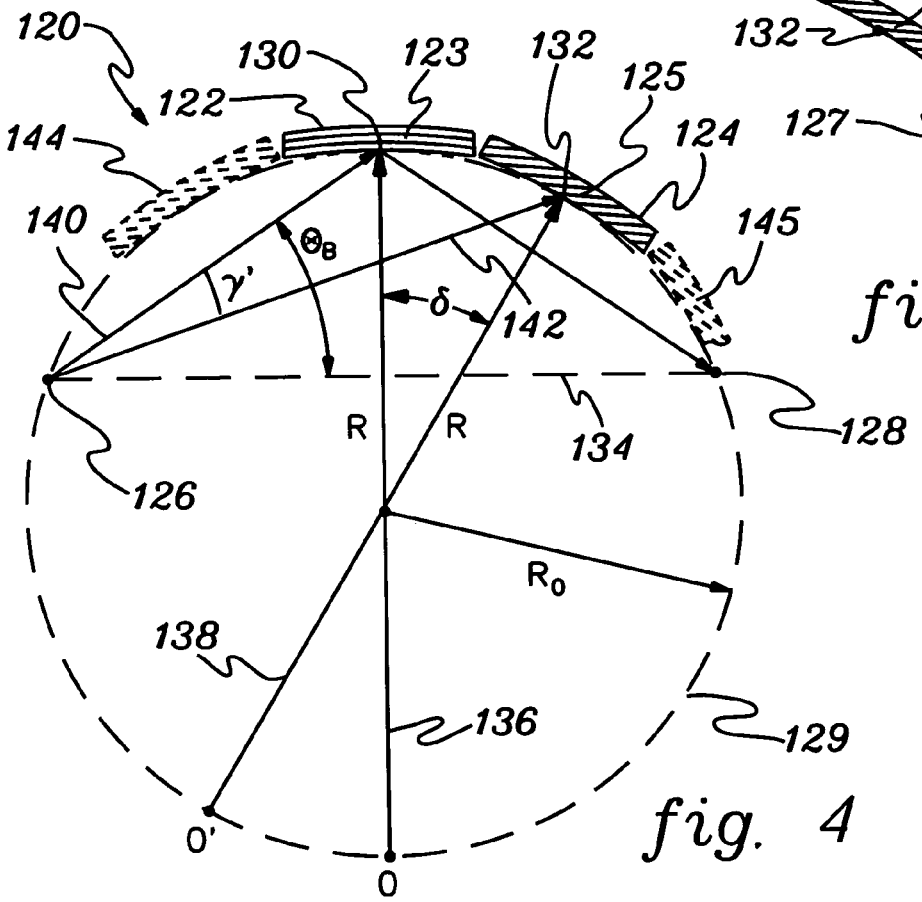
fig. 4A
fig. 4

OPTICAL DEVICE FOR DIRECTING X-RAYS HAVING A PLURALITY OF OPTICAL CRYSTALS

CROSS-REFERENCE TO RELATED APPLICATIONS

This application is a continuation of PCT Application PCT/US2003/023412, filed Jul. 25, 2003, and published under the PCT Articles in English as WO 2004/013867 A2 on Feb. 12, 2004. PCT/US2003/023412 claimed priority to U.S. Provisional Application No. 60/400,809, filed Aug. 2, 2002. The entire disclosures of PCT/US2003/023412 and U.S. Ser. No. 60/400,809 are incorporated herein by reference in their entirety.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract #1 R43 RR14935-01 awarded by the National Institutes of Health.

FIELD OF THE INVENTION

This invention relates generally to devices and methods for diffracting or focusing high-energy electromagnetic radiation. Specifically, the present invention provides improved methods and apparatus for directing or focusing x-rays using devices having a plurality of crystal optics having varying atomic diffraction planes.

BACKGROUND OF THE INVENTION

Implementation of x-ray analysis methods has been one of the most significant developments in twentieth-century science and technology. The use of x-ray diffraction, x-ray spectroscopy, x-ray imaging, and other x-ray analysis techniques has led to a profound increase in knowledge in virtually all scientific fields.

In areas of x-ray spectroscopy, high x-ray beam intensity is an essential requirement to reduce sample exposure times and, consequently, to improve the signal-to-noise ratio of x-ray analysis measurements. In the past, expensive and powerful x-ray sources, such as rotating anode x-ray tubes or synchrotrons, were the only options available to produce high-intensity x-ray beams. Recently, the development of x-ray optical devices has made it possible to collect the diverging radiation from an x-ray source by focusing the x-rays. A combination of x-ray focusing optics and small, low-power x-ray sources can produce x-ray beams with intensities comparable to those achieved with more expensive devices. As a result, systems based on a combination of small x-ray sources and collection optics have greatly expanded the capabilities of x-ray analysis equipment in, for example, small laboratories.

One existing x-ray optical technology is based on diffraction of x-rays on optical crystals, for example, germanium (Ge) or silicon (Si) crystals. Curved crystals can provide deflection of diverging radiation from an x-ray source onto a target, as well as providing monochromatization of photons reaching the target. Two different types of curved crystals exist: singly-curved crystals and doubly-curved crystals (DCC). Using what is known in the art as Rowland circle geometry, singly-curved crystals provide focusing in two dimensions, leaving x-ray radiation unfocused in the third or orthogonal plane. Doubly-curved crystals provide focusing of x-rays from the source to a point target in all three dimensions, for example, as disclosed by Chen and Wittry in the article "Microprobe X-ray Fluorescence with the Use of Point-focusing Diffractors," which appeared in Applied Physics Letters, 71 (13), 1884 (1997), the disclosure of which is incorporated by reference herein. This three-dimensional focusing is referred to in the art as "point-to-point" focusing.

The point-to-point focusing property of doubly-curved crystals has many important applications in, for example, material science structural analysis. Depending on the bending radii of the doubly-curved crystal in the Rowland optic circle plane, curved crystals further divide into Johansson and Johann types. Johansson geometry requires crystals to have a curvature that is equal to the radius of the Rowland circle, while Johann geometry configuration requires a curvature twice the radius of the Rowland circle.

One limitation of crystals based on Johann geometry is a low radiation collection angle and, subsequently, reduced deflected beam flux and beam intensity. One way to overcome this limitation, proposed in U.S. Pat. No. 5,127,028, entitled "Diffractor with doubly curved surface steps" of Wittry, is to use more than one diffracting crystal in a stepped geometry. However, the radiation collection angle having stepped geometry, as disclosed in U.S. Pat. No. 5,127,028, still has limitations. For example, such stepped-geometry prior art crystals provide a limited x-ray collection angle are also difficult to manufacture. There exists a need in the art to provide an x-ray focusing device and method which provide a larger collection angle to provide an even higher intensity monochromatic x-ray beam than that provided by the existing art.

X-ray sources typically generate diverging radiation. In order to increase x-ray beam flux, diverging radiation is typically collected and focused onto a target. Existing crystal-based focusing devices provide point-to-point focusing by diffracting x-ray radiation. Typically, the radiation collection angle of Johann-type optics is only between 1 degree and 5 degrees, that is, only a small fraction of the radiation emitted by an x-ray source typically reaches the target. Thus, there is a need in the art to provide devices and methods for capturing more of the divergent radiation and provide a high-intensity, x-ray beam focusing devices, systems, and methods with improved x-ray beam utilization.

One significant advantage of providing a high-intensity x-ray beam is that the desired sample exposure can typically be achieved in a shorter measurement time. The potential to provide shorter measurement times can be critical in many applications. For example, in some applications, reduced measurement time increases the signal-to-noise ratio of the measurement. In addition, minimizing analysis time increases the sample throughput in, for example, industrial applications, thus improving productivity. There is a clear need in the art to provide devices, systems, and methods that can be used to enhance x-ray analysis methods by reducing experimental measurement time.

SUMMARY OF THE INVENTION

The present invention provides methods and apparatus which address many of the limitations of prior art methods and apparatus.

In the following description, and throughout this specification, the expressions "focus", "focusing", and "focused", among others, may appear, for example, as in "focusing device", "x-ray focusing device", "means for focusing", "focusing optic", among others. Though according to the present invention these expressions can apply to devices or methods in which x-rays are indeed "focused", for example, caused to be concentrated, these expressions are not meant to limit the invention to devices that "focus" x-rays. According to the present invention, the term "focus" and related terms are intended to also serve to identify methods and devices which collect x-rays, collimate x-rays, converge x-rays, diverge x-rays, or devices that in any way vary the intensity, direction, path, or shape of x-rays. All these means of handling, manipulating, varying, modifying, or treating x-rays are encompassed in this specification by the term "focus" and its related terms.

Also, in the following discussion and throughout this specification, for ease of illustration, the prior art and the various aspects of the present invention will be discussed in terms of their application to the modification of the path of x-ray radiation, but it is understood that the present invention is applicable to the manipulation of other types of radiation, for example, x-rays, gamma rays, and neutrons. Thus, the scope of the present invention is not limited to the manipulation of x-ray beams.

One aspect of the invention is an optical device for directing x-rays, the optical device including a plurality of optical crystals positioned with an x-ray source and an x-ray target to define at least one Rowland circle of radius R and a source-to-target line, wherein the optical device provides focusing of x-rays from the source to the target. In one aspect of the invention, the at least one of the plurality of optical crystals may have a surface upon which x-rays are directed, and wherein at least one of the plurality of optical crystals comprises a set of atomic diffraction planes having a Bragg angle $\theta_B$ and oriented at an angle $\gamma$ with the surface of the at least one of the plurality of optical crystals, and wherein a line drawn from the x-ray source to a point on the surface of the at least one of the plurality of optical crystals makes an angle $\theta_B+\gamma$ with the source-to-target line. In another aspect of the invention, the line drawn from the x-ray source to a point on the surface of the at least one of the plurality of optical crystals may be a line drawn from the x-ray source to the midpoint of the surface of the at least one of the plurality of optical crystals. In one aspect of the invention, the line drawn from the x-ray source to a point on the surface of the at least one of the plurality of optical crystals may be a line drawn from the x-ray source to about the point of tangency of the surface of the at least one of the plurality of optical crystals and the Rowland circle of the at least one of the plurality of optical crystals. In one aspect of the invention, the plurality of optical crystals may have a radius in the plane of the Rowland circle of about 2R. In one aspect of the invention, at least one of the crystals is a doubly-curved crystal, for example, a toroidal doubly-curved crystal. In one aspect of the invention, the optical device may have a toroidal angle of at least about 30 degrees. In one aspect of the invention, the device may be combined with a source of x-rays.

Another aspect of the invention is an optical device for directing x-rays, the optical device including a plurality of optical crystals positioned with an x-ray source and an x-ray target to define at least one Rowland circle of radius R and a source-to-target line, wherein the optical device comprises a toroidal angle about the source-to-target line of at least about 90 degrees. In one aspect of the invention, the optical device may have a toroidal angle about the source-to-target line of at least about 180 degrees, or at least about 270 degrees, or about 360 degrees. In one aspect of the invention, the device provides point-focusing of x-rays. In one aspect of the invention, at least one of the plurality of optical crystals has a surface upon which x-rays are directed, and wherein at least one of the optical crystals comprise a set of atomic diffraction planes having a Bragg angle $\theta_B$ and oriented at an angle $\gamma$ with the surface of the at least one of the optical crystals and wherein a line drawn from the x-ray source to a point on the surface of the at least one of the optical crystals makes an angle $\theta_B+\gamma$ with the source-to-target line. In another aspect of the invention, the line drawn from the x-ray source to the point on the surface of the at least one of the optical crystals comprises a line drawn to the midpoint of the at least one of a plurality of optical crystals. In another aspect of the invention, the line drawn from the x-ray source to the point on the surface of the at least one of the optical crystals comprises a line drawn to the point of tangency of the surface of the at least one of the plurality of optical crystals and the Rowland circle of the at least one of the plurality of optical crystals. In one aspect of the invention, the plurality of optical crystals have a radius in the plane of the Rowland circle of about 2R. In another aspect of the invention, the optical device may further include a second plurality of optical crystals positioned with the x-ray source and the x-ray target to define at least one Rowland circle, wherein the second plurality of optical crystals have a radius in the plane of the Rowland circle of about 2R, and wherein the optical device comprises a toroidal angle about the source-to-target line of at least about 90 degrees.

Another aspect of the invention is an optical device for directing x-rays, the device including a plurality of optical crystals arranged in a matrix, the matrix being positionable to define at least one Rowland circle with an x-ray source and an x-ray target, and wherein the matrix comprises a plurality of rows, with each row comprising multiple optical crystals of the plurality of optical crystals. In one aspect of this invention, at least one of the crystals is a doubly-curved crystal, for example, a toroidal doubly-curved crystal. In another aspect of the invention, the toroidal doubly-curved crystal defines a toroidal direction and the plurality of rows may be spaced in the toroidal direction or a direction orthogonal to a plane of at least one Rowland circle. In another aspect of the invention, the crystals may have at least one lattice plane and the at least one lattice plane of at least one of the crystals may be parallel to a surface of the crystal; in another aspect of the invention, the at least one lattice plane of at least one of the crystals may be non-parallel to the surface of the crystal. In another aspect of the invention, the at least one toroidal doubly-curved crystal defines a toroidal direction, and wherein an arcuate length of the device in the toroidal direction may be at least about 45 degrees, or at least about 60 degrees, or at least about 90 degrees. The device may also act as a monochromator. In another aspect of the invention, the device may further comprise the device in combination with the source of x-rays. In another aspect of the invention, the source of x-rays may consume less than about 100 Watts, typically less than about 50 Watts, and may even consume less than about 25 Watts or even less than about 10 Watts.

Another aspect of this invention comprises a method for directing x-rays, the method including the steps: providing an optical device, the optical device comprising a plurality of optical crystals arranged in a matrix, the matrix being positionable to define at least one Rowland circle with an x-ray source and an x-ray target, and wherein the matrix comprises a plurality of rows, with each row comprising multiple optical crystals of said plurality of optical crystals; and positioning the optical device wherein at least some x-rays from the x-ray source are directed to the x-ray target. In one aspect of the invention of this invention, positioning the optical device may comprise positioning the device wherein at least some x-rays emitted by the source impinge at least some of the crystals of the optical device wherein at least some of the x-rays are diffracted.

Another aspect of the invention is a device for directing x-rays, the device including a first curved crystal and at least one second curved crystal spaced from the first crystal, the first and at least one second curved crystal each including at least one lattice plane, and the first curved crystal and the at least one second curved crystal being positionable to define at least one Rowland circle with an x-ray source and an x-ray target, wherein at least some x-rays impinging upon the first curved crystal and the at least one second curved crystal are directed to the target, and wherein the angle of the at least one lattice plane of the first crystal relative to a surface of the first crystal is different from an angle of the at least one lattice plane of the at least one second crystal relative to a surface of the at least one second crystal. In one aspect of the invention, the angle of the lattice planes of the first crystal relative to the surface of the first crystal may be about zero. In one aspect of the invention, the angle of the at least one lattice plane of the at least one second crystal relative to the surface of the at least one second crystal is different from the angle of the lattice planes of the first crystal, for example, the angle of the lattice planes of the at least one second crystal may be different form zero degrees, for instance, about 1 to about 5 degrees. In another aspect of the invention, a line directed from the x-ray source to the center of a surface of the first curved crystal and a line directed from the x-ray source to the center of a surface of the at least one second crystal may define an angle $\gamma$. In one aspect of the invention, the angle of the at least one lattice plane of the at least one second crystal relative to the surface of the at least one second crystal may be an angle $\gamma$, for example an angle of between about minus 15 degrees and about plus 15 degrees or between about minus 4 degrees and about plus 4 degrees. In another aspect of this invention, the first curved crystal and the at least one second crystal may comprise a first set of crystals, and the device further comprises at least one second set of crystals which are also positioned to define a Rowland circle with the x-ray source and the x-ray target, wherein at least some x-rays which impinge upon the at least one second set of crystals are directed to the x-ray target, the target being common with the first set of crystals, and wherein the second set of crystals is spaced from the first set of crystals in a direction orthogonal to a plane of the Rowland circle of the first set of crystals. In one aspect of the invention, a radius of curvature of a surface of the first curved crystal in the plane of the Rowland circle and a radius of curvature of a surface of the at least one second crystal in the plane of the Rowland circle are about equal to twice the radius of the Rowland circle of the device. In one aspect of the invention, the device provides point focusing of x-rays on the x-ray target, for example, point-to-point focusing from the x-ray source to the x-ray target. In another aspect of the invention, the device further comprises a backing plate onto which the first curved crystal and at least one second curved crystal are mounted. In one aspect of the invention, the device comprises a monochromator.

Another aspect of the invention is a device for directing x-rays, comprising a curved crystal optic positionable to define at least one Rowland circle with an x-ray source and an x-ray target, wherein at least some x-rays emitted by the source impinge upon the crystal and are directed to the target, the curved crystal optic comprising at least one lattice plane, wherein the at least one lattice plane of the curved crystal optic is oriented at an angle $\gamma_1$ relative to a surface of the curved crystal optic. In one aspect of the invention, the curved crystal optic may be a doubly-curved crystal optic and have a curvature in a plane orthogonal to a plane of the Rowland circle, for example, having an arc length of the curved crystal optic in a direction orthogonal to a plane of the Rowland circle of at least about 45 degrees. In one aspect of the invention, the curved crystal optic may comprise a plurality of curved crystals. In one aspect of the invention, the arc length of the curved crystal optic in a direction orthogonal to the plane of the Rowland circle is at least about 90 degrees, or at least about 180 degrees, or about 360 degrees. In one aspect of the invention, the angle of orientation $\gamma_1$ of the at least one lattice plane relative to the surface of the curved crystal optic may be between about minus 4 degrees and about plus 4 degrees. In one aspect of the invention, the crystal may have a bending radius of between about 20 mm and about 600 mm, for example, in one or more planes or directions. In another aspect of the invention, the device may further include a backing plate onto which the curved crystal optic is mounted.

Another aspect of the invention is a circular optic for diffracting x-rays, comprising at least one curved crystal optic positionable to define at least one Rowland circle with an x-ray source and an x-ray target, wherein at least some x-rays impinging upon the curved crystal optic are directed to the target, wherein the at least one curved crystal optic comprises at least one lattice plane and wherein the at least one lattice plane of the at least one curved crystal optic is oriented at an angle $\gamma_1$ relative to a surface of the at least one curved crystal optic. In one aspect of the invention, the at least one curved crystal optic may comprise at least one doubly-curved crystal. In another aspect of the invention, the at least one curved crystal optic may comprise a plurality of curved crystals. In one aspect of the invention, the angle $\gamma_1$ may be between about minus 4 degrees and about plus 14 degrees. In one aspect of the invention, the circular optic may have a bending radius between about 20 mm and about 600 mm. In one aspect of the invention, the circular optic provides point focusing on the x-ray target (for example, on a sample), for example, point-to-point focusing from the x-ray source to the x-ray target. In one aspect of the invention, the circular optic may further comprise a backing plate onto which the at least one curved crystal optic is mounted.

These and other embodiments and aspects of the present invention will become more apparent upon review of the attached drawings, description below, and attached claims.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following detailed descriptions of the preferred embodiments and the accompanying drawings in which:

FIG. 3 is an isometric view of an arrangement of optic crystals and the arrangement's corresponding Rowland circle geometry according to one aspect of the present invention.

FIG. 4 is a is a sectional view, similar to FIG. 2, through section 4—4 shown in FIG. 3 and illustrating typical Rowland optic circle geometry for the optic shown in FIG. 3 according to one aspect of the present invention.

FIG. 4A is a detailed view of one optical crystal shown in FIG. 4 illustrating the angle of orientation of the atomic planes relative to the surface of the crystal according to one aspect of the present invention.

DETAILED DESCRIPTION OF THE PREFERRED EMBODIMENTS

Figure 1:
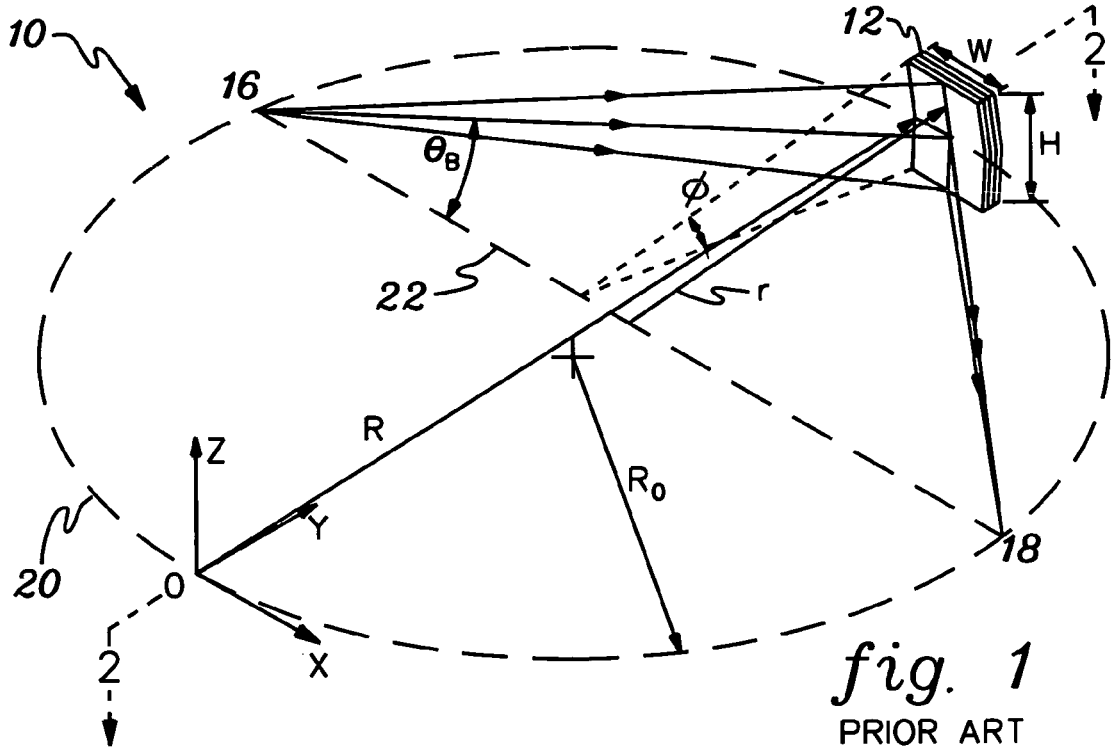
fig. 1 PRIOR ART
FIG. 1 is an isometric view of a typical prior art optic used to diffract x-rays over which the present invention is an improvement.
Figure 2:
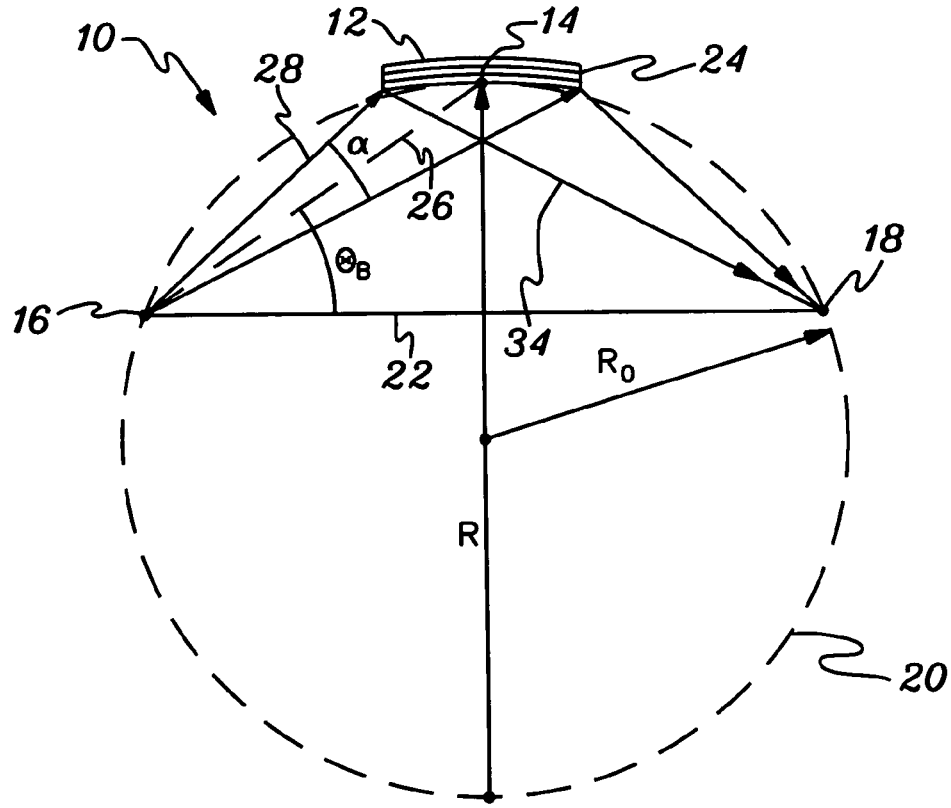
fig. 2 PRIOR ART
FIG. 2 is a sectional view taken through section 2—2 shown in FIG. 1 and illustrating typical Rowland optic circle geometry for the optic shown in FIG. 1.

FIGS. 1 and 2 illustrate a typical prior art x-ray optical device over which the present invention is an improvement. Again, in the following description, the various aspects of the present invention will be discussed in terms of their application to the modification of the path of x-ray radiation, but it is understood that the present invention is applicable to the manipulation of other types of radiation, for example, x-rays, gamma rays, or neutrons, among other types. That is, the scope of the present invention is not limited to the manipulation of x-ray beams.

FIG. 1 is a typical isometric view of a prior art x-ray focusing arrangement 10 and FIG. 2 is a cross-sectional view of arrangement 10 as viewed along lines 2—2 in FIG. 1. FIGS. 1 and 2 include the geometry of the corresponding Rowland circle 20 associated with arrangement 10. Arrangement 10 includes a doubly-curved crystal (DCC) optic 12, an x-ray source location 16, and an x-ray target location 18, at which the x-ray image is preferably produced. In FIGS. 1 and 2, and in subsequent aspects of the present invention, x-ray source location 16 represents the source location for a point-like x-ray source. Similarly, in FIGS. 1 and 2 and elsewhere in this specification, target location 18 may be any target at which x-rays or other radiation may be directed. For example, target location 18 may be the location of a chemical specimen undergoing x-ray spectroscopy, human tissue undergoing radiation treatment, or a semiconductor chip undergoing surface analysis, among other things. In addition, the target location 18 may include an x-ray detector for detecting secondary x-rays emitted by the target.

As most clearly shown in FIG. 2, the optic 12 has an optic center point 14, and the x-ray source location 16, optic center point 14, and the x-ray target location 18 define a circle 20 known in the art as the Rowland circle or focal circle. Rowland circle 20 has radius RO defined in the art as the Rowland or focal radius. Crystal 12 has a width W and a height H, as shown in FIG. 1. X-ray source location 16 and an x-ray target location 18 are joined by line 22, which is referred to in the art as the "source-to-image connecting line". The coordinate system of the arrangement shown in FIGS. 1 and 2 has its origin at the point O.

In FIGS. 1 and 2, the surface of crystal 12 has a radius R measured from origin O. Crystal 12 typically contains one or more crystal lattice planes (also known as atomic diffraction planes) represented by lines 24. In this typical prior art optic the lattice planes 24 are essentially parallel to the surface of crystal 12. Though prior art optics may be designed for Johan or Johansson geometry, the arrangement shown in FIGS. 1 and 2 has Johan-type geometry in which the radius of curvature R of the surface of crystal 12 is twice the Rowland radius $R_O$, that is, $R=2R_O$.

As most clearly shown in FIG. 1, prior art crystal 12 is typically a doubly-curved crystal (DCC), that is, in addition to having a radius of curvature R in the plane of circle 20 (that is, the Rowland plane), crystal 12 also has a radius of curvature r in the plane orthogonal to the plane of circle 20. The direction of curvature r is typically referred to in the art as the toroidal curvature of crystal 12, and r is referred to as the "toroidal rotation radius". This toroidal direction is indicated by angle $\phi$ in FIG. 1. In order to provide essentially point-to-point focusing, DCC 12 typically has a toroidal rotation radius, r, that is equal to the perpendicular distance between crystal center point 14 and source-to-image connecting line 22.

The angle $\theta_B$ shown in FIG. 2 is known in the art as the "Bragg angle", that is, the critical angle of incidence of the x-ray radiation from source location 16 upon the surface of crystal 12 whereby the most radiation is diffracted toward target location 18. At angles of incidence larger and smaller than the Bragg angle less incident radiation is diffracted to the target. The Bragg angle for a system is a function of the crystal used and the frequency of the x-ray radiation used, among other things. In the typical prior art system shown in FIG. 2, system 10 is designed so that the angle of incidence of the x-rays, as indicated by phantom line 26, on center 14 of the surface of crystal 12 relative to source-to-image connecting line 22, is equal to the Bragg angle for the system, typically an angle between about 5 degrees and about 30 degrees. Lines 28 and 30 in FIG. 2 illustrate the divergence of x-ray photons from the source location 16 and lines 32 and 34 illustrate the convergence of x-ray photons to the target location 18 as diffracted by crystal 12. The angle of incidence of the incident x-rays, as indicated by lines 28 and 30, varies from the ideal Bragg angle as the location of the point of impingement varies from center 14. The angle " between lines 28 and 30 in the plane of the Rowland circle 20 is referred to in the art as the "crystal collection angle". In terms of the Bragg angle, the ideal toroidal curvature r is given by the expression $2R\sin^2\theta_B$. These terms and dimensions used to define the geometry of the prior art shown in FIGS. 1 and 2 will be helpful in describing the present invention.

In system 10 of FIGS. 1 and 2, photons emitted from source location 16, which is any conventional x-ray point source, experience Bragg diffraction on crystal 12 and form an image at target location 18. The focus aberration of the image at target location 18 is proportional to the width W of crystal 12 and, consequently, to the crystal collection angle α. Focus aberration considerations typically limit " to a value of 1 to 5 degrees, which in turn limits x-ray source radiation utilization. One way to increase the source utilization is to increase the width W of optic 12, but increasing width W increases the focus aberration of the optic due to deviation from the desired Bragg angle of incidence upon the surface of the wider optic.

Though the prior art optical system illustrated in FIGS. 1 and 2 can effectively capture x-rays emitted from a divergent source and focus x-rays onto a target, the capacity of this and related prior art systems to utilize as much x-ray energy as possible is limited due to, among other things, their limited ability to capture sufficient x-rays. Another prior art x-ray focusing system is disclosed in U.S. Pat. No. 5,127,028, entitled "Diffractor with doubly curved surface steps". However, though the optics disclosed in U.S. '028 provides good coverage in the collection angle in the Rowland circle plane, the U.S. '028 optics are limited in their coverage in the plane orthogonal to the Rowland circle plane and source-to-image connecting line, for example, line 22 in FIG. 2.

FIGS. 3 and 4 illustrate one aspect of the present invention which overcomes the limitations of the prior art systems, for example, system 10 illustrated in FIGS. 1 and 2 and the art disclosed in U.S. '028. FIG. 3 is a representative isometric view of an x-ray focusing arrangement 120 having a first curved crystal optic 122, a second crystal optic 124, an x-ray source location 126, and an x-ray target location 128. FIG. 4 is a sectional view as viewed along section lines 4—4 shown in FIG. 3. Crystal optics 122 and 124 may comprise doubly-curved crystals and may be mounted on a crystal support frame, which is not shown for ease of illustration, but which is known in the art. According to one aspect of the present invention, first crystal optic 122 has at least one crystal lattice plane 123 and second crystal optic 124 has at least one crystal lattice plane 125. The center point of crystal optics 122 and 124 are identified as points 130 and 132, respectively. As most clearly shown in FIG. 10, the x-ray source location 126; optic center points 130, 132; and x-ray target location 128 define the Rowland circle 129 of radius $R_O$ for arrangement 120. X-ray source location 126 and x-ray target location 128 are joined by a source-to-image connecting line 134. $\theta_B$ is the Bragg angle for the first crystal optic 122. Focusing arrangement 120 further includes a first crystal radius 136 having an origin 0 for first crystal optic 122 and a second crystal radius 138 having an origin O' for second crystal optic 124. First crystal radius 136 and second crystal radius 138 drawn to the counterpoints 130, 132 of their respective crystals make an angle 6 with each other. In one aspect of the invention, radii 136 and 138 are about equal, that is, the length of radii 136, 138 are within about 10% of each other.

According to one aspect of the invention shown in FIGS. 3 and 4, the utilization of x-ray energy emitted by a divergent x-ray source positioned at source location 126 is optimized or maximized, compared to prior art arrangements. In one aspect of the invention, this is achieved by varying the orientation of the lattice planes 123, 125 relative to the surfaces of the crystal optics 122, 124, respectively. For instance, in one aspect of the invention, the lattice planes 123 of crystal 122 may be parallel to the surface of the crystal, for example, as in crystal 12 shown in FIGS. 1 and 2. However, according to one aspect of the present invention, the lattice planes 125 of crystal 124 are not parallel to the surface of the crystal but are offset an angle γ relative to the surface of the crystal. In order to compensate for the orientation of crystal 124 relative to the source location 126 (that is, an orientation providing an angle of incidence on crystal 124 which is different, for example, greater, than the desired Bragg angle for the crystal), the orientation of the lattice planes 125 of crystal 124 relative to the surface of crystal 124 is varied to create the desired Bragg angle of incidence on the lattice planes of crystal 124. As shown most clearly in the detail of FIG. 4A, according to this aspect of the invention, lattice planes 125 of crystal 124 make an angle γ with a line 127 tangent to the surface of crystal 124 at the point lattice plane 125 intersects the surface of crystal 124. According to one aspect of the invention, line 140 connecting source location 126 and center point 130 of first optic crystal 122 and line 142 connecting source location 126 and center point 132 of second optic crystal 124 make an angle γ'. In one aspect of the invention, the angle of orientation of the lattice planes 125 of crystal 124 relative to its surface is about equal to γ', that is, γ~γ'. In one aspect of the invention, γ and γ' are essentially identical within the fabrication tolerances of arrangement 120. According to this aspect of the present invention, the diffraction conditions of photons emitted from source location 126 are about equal for both first crystal 122 and second crystal 124. In one aspect of the invention, the value of γ and γ' typically varies from about minus 15 degrees to about plus 15 degrees, but in one aspect of the invention γ and γ' are preferably between about minus 10 degrees and about plus 10 degrees.

Though in the simplest embodiment of the aspect of the invention shown in FIGS. 3 and 4 only two crystals 122 and 124 may be used, according to another aspect of the invention at least a third crystal 144 or 145 (shown in phantom in FIG. 4) or more crystals may be used. The lattice plane orientation γ of optic crystals 144 and 145 may be oriented to again maximize the Bragg diffraction of x-rays impinging upon the surface of crystal 144 and 145. In another aspect of the invention, further crystals (for example, 5, 7, or more crystals in a row) may be used with appropriate variation in lattice plane orientation to maximize the utilization of the x-rays emitted at source location 126. In addition, in one aspect of the invention, further rows of crystals may be used having appropriate variation in lattice plane orientation. For example, in a fashion similar to the crystal matrix shown in, two or more rows of crystals may be used. For example, rows similar to crystals 122, 124, and 144 or 145 which are offset from each other in a direction orthogonal to the plane of Rowland circle 129 may be used. The orientation of the lattice planes in each of the crystals in these matrices can be varied to effect optimum Bragg diffraction so that x-ray utilization is maximized. In one aspect of the invention, the crystals, 122, 124, 144, 145, and others may be positioned about the same Rowland circle 129. In another aspect of the invention, crystals 122, 124, 144, 145, and others may be positioned about different Rowland circles, for example, Rowland circles lying in a plane oriented obliquely to the plane of Rowland circle 129.

Figure 5:
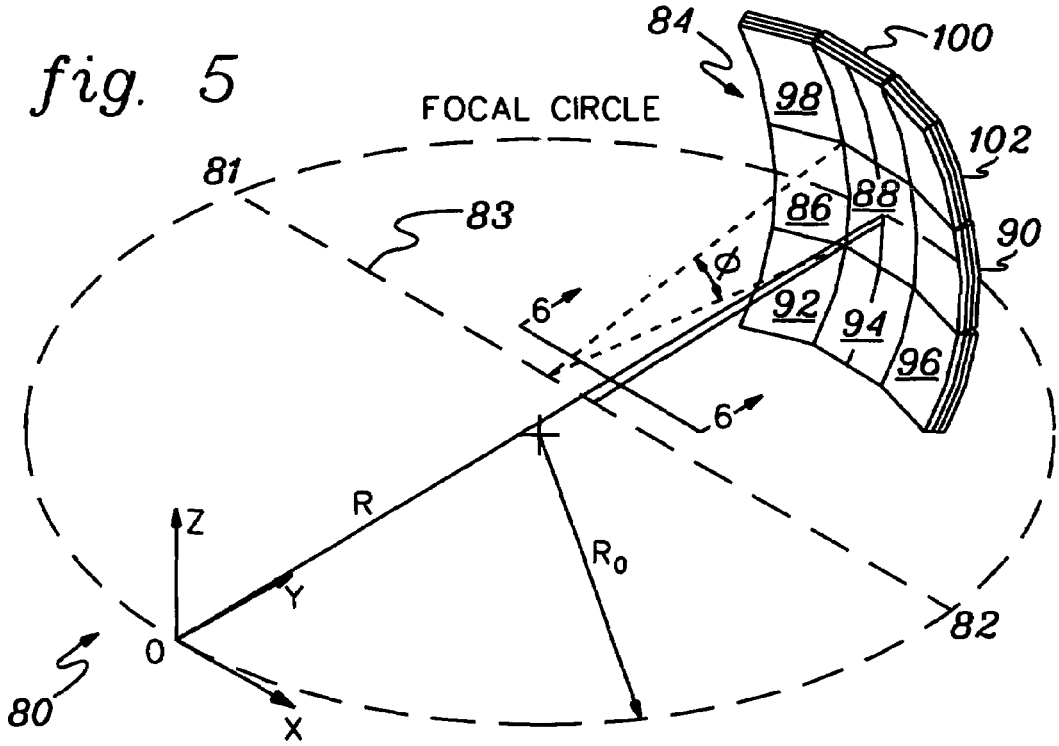
FIG. 5 is an isometric view of an arrangement of optic crystals and the arrangement's corresponding Rowland circle geometry according to one aspect of the present invention.
Figure 6:
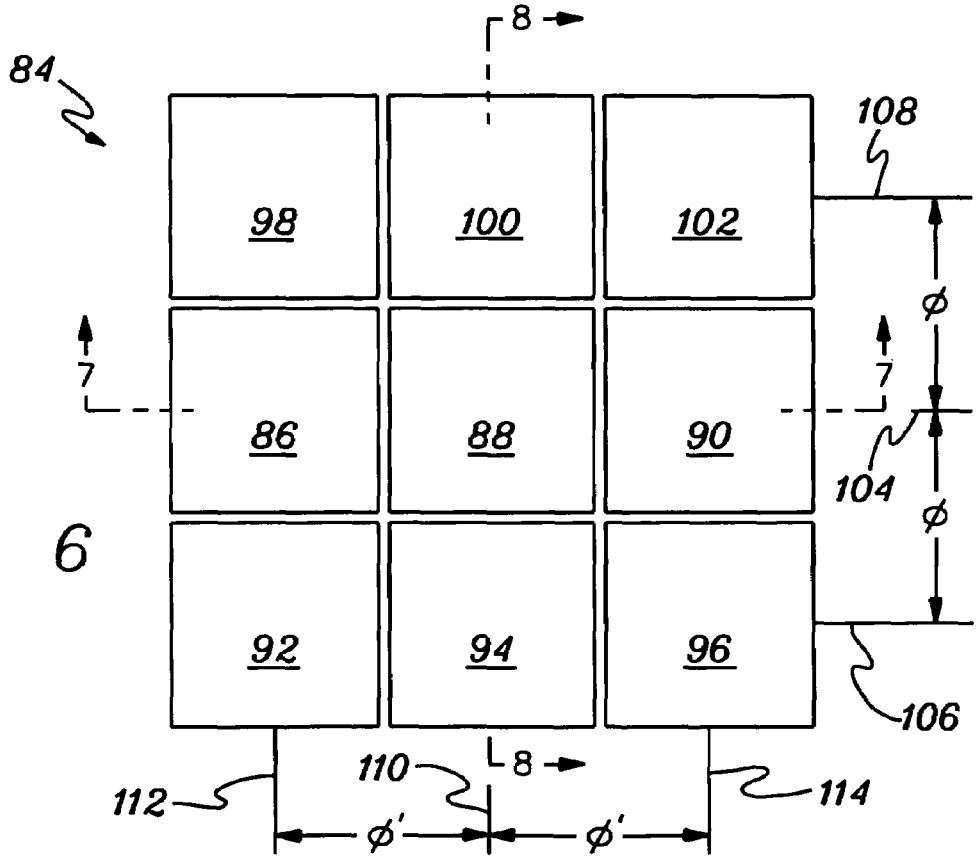
FIG. 6 is a projection view of the arrangement of optic crystals shown in FIG. 5 taken along view lines 6—6 in FIG. 5 according to one aspect of the present invention.
Figure 6A:
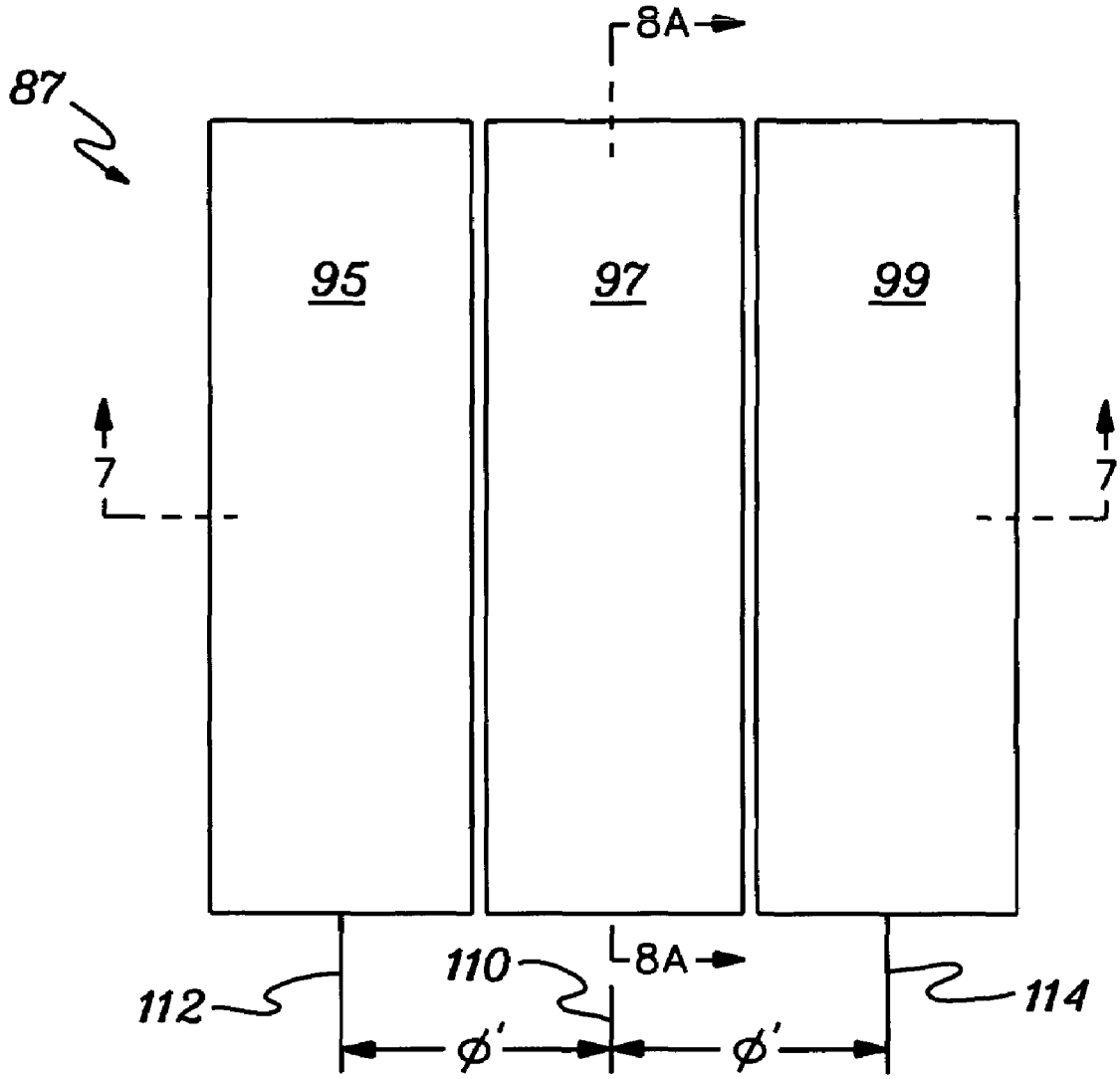
FIG. 6A is a projection view of the another arrangement of optic crystals shown in FIG. 5 taken along view lines 6—6 in FIG. 5 according to one aspect of the present invention.
Figure 7:
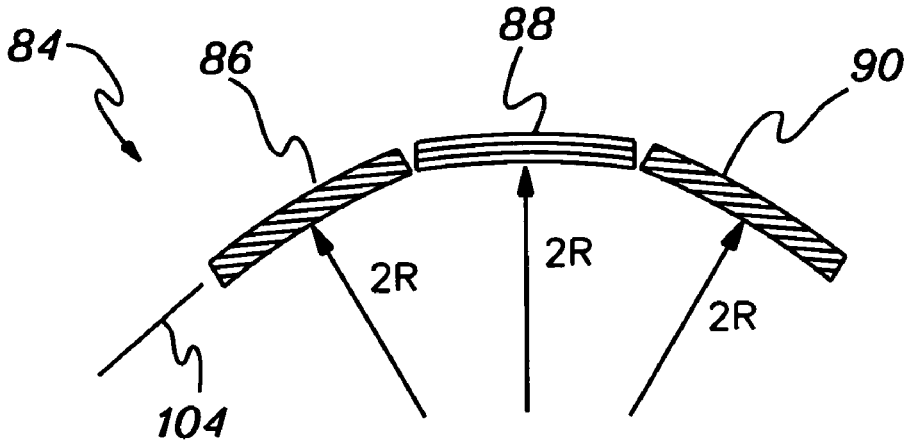
FIG. 7 is a cross-sectional view of the arrangement of optic crystals shown in FIGS. 5 and 6 as viewed along view lines 7—7 in FIG. 6 according to one aspect of the present invention.
Figure 8:
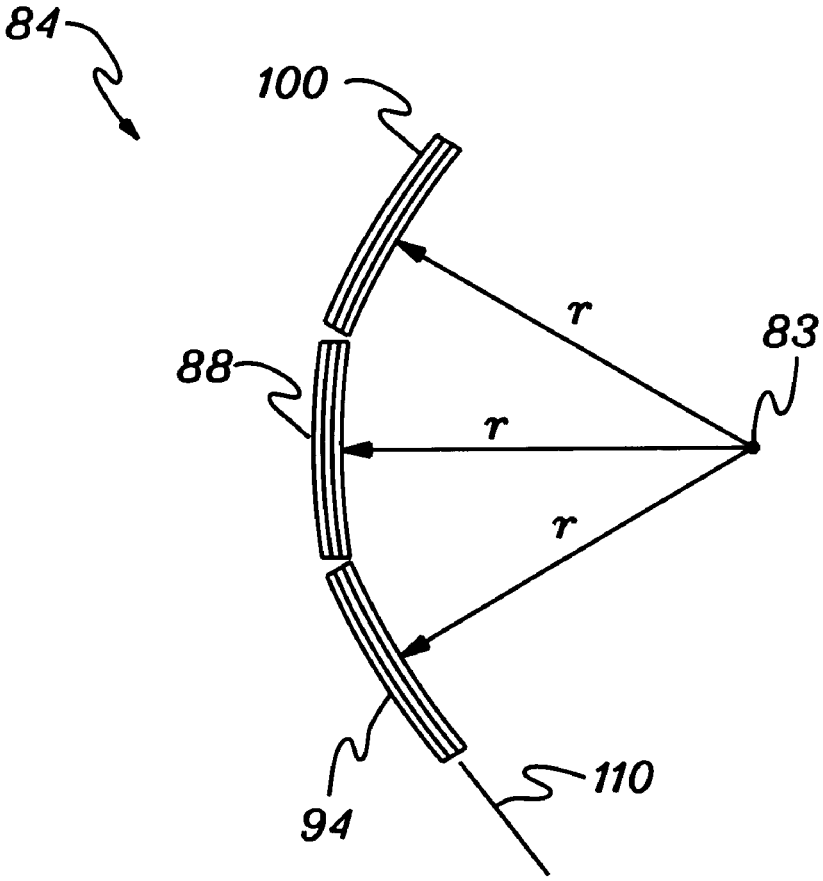
FIG. 8 is a cross-sectional view of the arrangement of optic crystals shown in FIGS. 5 and 6 as viewed along view lines 8—8 in FIG. 6 according to another aspect of the present invention.
Figure 8A:
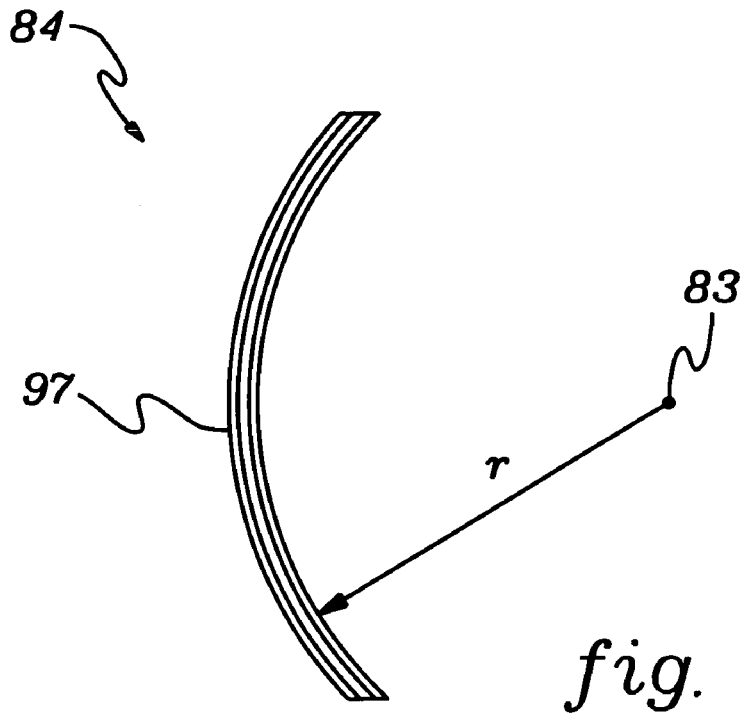
FIGS. 8A and 8B are cross-sectional views of the arrangement of optic crystals shown in FIGS. 5 and 6 as viewed along view lines 8—8 in FIG. 6 according to another aspect of the present invention.

FIG. 5 illustrates a representative isometric view of an x-ray focusing arrangement 80 according to one aspect of the present invention. FIG. 5 is similar to FIGS. 1 and 3 and illustrates similar parameters shown earlier, for example, a source location 81, a target location 82, and a source to target line 83 which define a Rowland circle 85. According to this aspect of the invention, arrangement 80 includes a matrix or mosaic 84 comprising a plurality of crystal optics, for example, doubly-curved crystal optics, 86, 88, 90, 92, 94, 96, 98, 100 and 102. FIG. 6 illustrates a projection of the crystals as viewed via line 6—6 shown in FIG. 5. These optics are typically mounted in a rigid support frame, for example, but the frame is omitted from FIGS. 5 and 6 for ease of illustration. FIG. 6A presents a view similar to FIG. 6 but illustrates another aspect of the present invention. In FIG. 6A, matrix 87 is provided by curved crystals 95, 97 and 99 which are longer than the crystals shown in FIG. 6, for example, optic crystals 95, 97, and 99 have an angular extension perpendicular to the plane of Rowland circle 85 that is longer than, for example, for example, optic crystals 86, 88, and 90. According to one aspect of the invention, curved crystals 95 and 99 may also have atomic planes that are not parallel to the surface of their respective crystals. FIG. 7 illustrates a cross-sectional view of optic mosaic 84 as viewed along lines 7—7 shown in FIG. 6 or of optic mosaic 87 along lines 7—7 shown in FIG. 6A. FIG. 8 illustrates a cross-sectional view of optic mosaic 84 as viewed along lines 8—8 shown in FIG. 6. FIG. 8A illustrates a cross-sectional view of optic mosaic 87 as viewed along lines 8A—8A shown in FIG. 6A.

As shown in FIG. 7, the middle row of crystals, that is, crystals 86, 88, and 90, having a center line 104 (see FIG. 6), are essentially the same as crystals 144, 123, and 124 shown in FIG. 4 having radii in the Rowland plane equal to about R. The bottom row of crystals in FIG. 6, that is, crystals 92, 94, and 96 having a centerline 106, and the top row of crystals, that is, crystals, 98, 100, and 102 having a centerline 108, may also have a radius R. However, as clearly shown in FIGS. 5 and 6, the top row of crystals and the bottom row of crystals are offset or spaced in the toroidal direction from the middle row of crystals. For example, the centerlines 106 and 108 are typically spaced from centerline 104 by $\phi$ degrees, for example, at least about 5 degrees. The angle $\phi$ will typically vary depending upon the dimensions of mosaic 84, but is typically between about 30 degrees and about 90 degrees. According to one aspect of the invention, the angular spacing between rows is typically uniform, thought the spacing may be non-uniform.

Figure 8B:
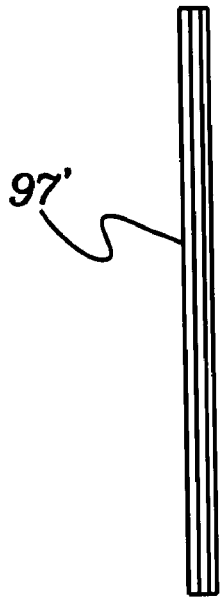

As shown in FIG. 8, the middle column of crystals, that is, crystals 94, 88, and 100, having centerline 110 (see FIG. 6), are each typically similar to crystal 12 shown in FIG. 1 having a toroidal radius r, though crystals with varying values of r may be used. As shown in FIG. 8B, in the aspect of the invention having longer individual crystals, as shown in FIG. 6A, the longer crystals 85, 97, and 99 may also have a toroidal radius r. According to another aspect of the invention, as shown in FIG. 8B, optic crystal 97' may also be a singly-bent crystal, for example, a crystal curved in the dispersive plane and not curved on the non-dispersive plane. In one aspect of the invention, similar singly-bent crystals 95' and 99' (not shown) which are similar to crystals 95 and 99 shown in FIG. 6A may have atomic planes that are not parallel to the surface of their respective crystal. As shown in FIG. 6, the right-hand column of crystals, that is, crystals 86, 92, and 98 having a centerline 112, and the left-hand column of crystals, that is, crystals, 90, 96, and 102, having a centerline 114, may have similar toroidal radii in a direction orthogonal to their respective Rowland circles.

As shown in FIG. 5 and 6, the right column of crystals and the left-hand column of crystals may be offset or spaced in the circumferential direction from the middle column of crystals. For example, the centerlines 112 and 114 may be spaced from centerline 110 by an angle $\phi'$, for example, an angle of at least about 5 degrees. The angle $\phi'$ may typically vary depending upon the dimensions of the mosaic 84, but may be between about 30 degrees and about 90 degrees. According to one aspect of the invention, the angular spacing between columns may be uniform, though the spacing may be non-uniform.

In operation, each row of crystals in matrix 84 performs like multi-crystal focusing system 40 shown in FIGS. 3 and 4. Therefore, a focusing system based on multi-crystal focusing assembly 82 shown in FIGS. 5 and 6 can typically triple the spatial coverage of multi-crystal focusing system 40. In this approach, a larger number of optical elements can be used to provide an additional improvement in x-ray source utilization. Though the aspect of the invention shown in FIGS. 5 and 6 illustrates a crystal matrix having 3 rows of crystals each row having 3 crystals (or 9 crystals in the matrix), according to one aspect of the invention, at least 2 rows of 2 crystals (that is, at least 4 crystals) may be used. Similarly, other matrices of crystals may be used according to the invention, for example, a 2×3 matrix, a 4×4 matrix, an 8×8 matrix, or a 10×12 matrix, among others, may be used. Regardless of the number of crystals in matrix 84, the arcuate length of matrix 84 in the toroidal direction or in the circumferential direction (that is, the arcuate direction orthogonal to the toroidal direction) may both vary from about 10 degrees to about 360 degrees, but the arcuate length in the toroidal direction is typically at least about 5 degrees and the arcuate length in the dispersive direction is typically at least about 5 degrees.

According to one aspect of the invention, the crystals in matrix 84 may be comprised of the same or similar materials, for example, silicon or germanium. However, in another aspect of the invention, the material composition of the crystals in matrix 84 may vary. In one aspect of the invention, the crystals in matrix 84 are doubly-curved crystals. According to one aspect of the invention, the lattice planes of the crystals in matrix 84 are parallel to the surface of the crystals. However, in another aspect of the invention, the lattice planes may not be parallel to the surface of the crystal. For example, the orientation of the lattice planes in the crystals of matrix 84 may vary, for example, in a linear or non-linear fashion, to maximize the focusing of the x-rays on the target location 82.

Figure 9:
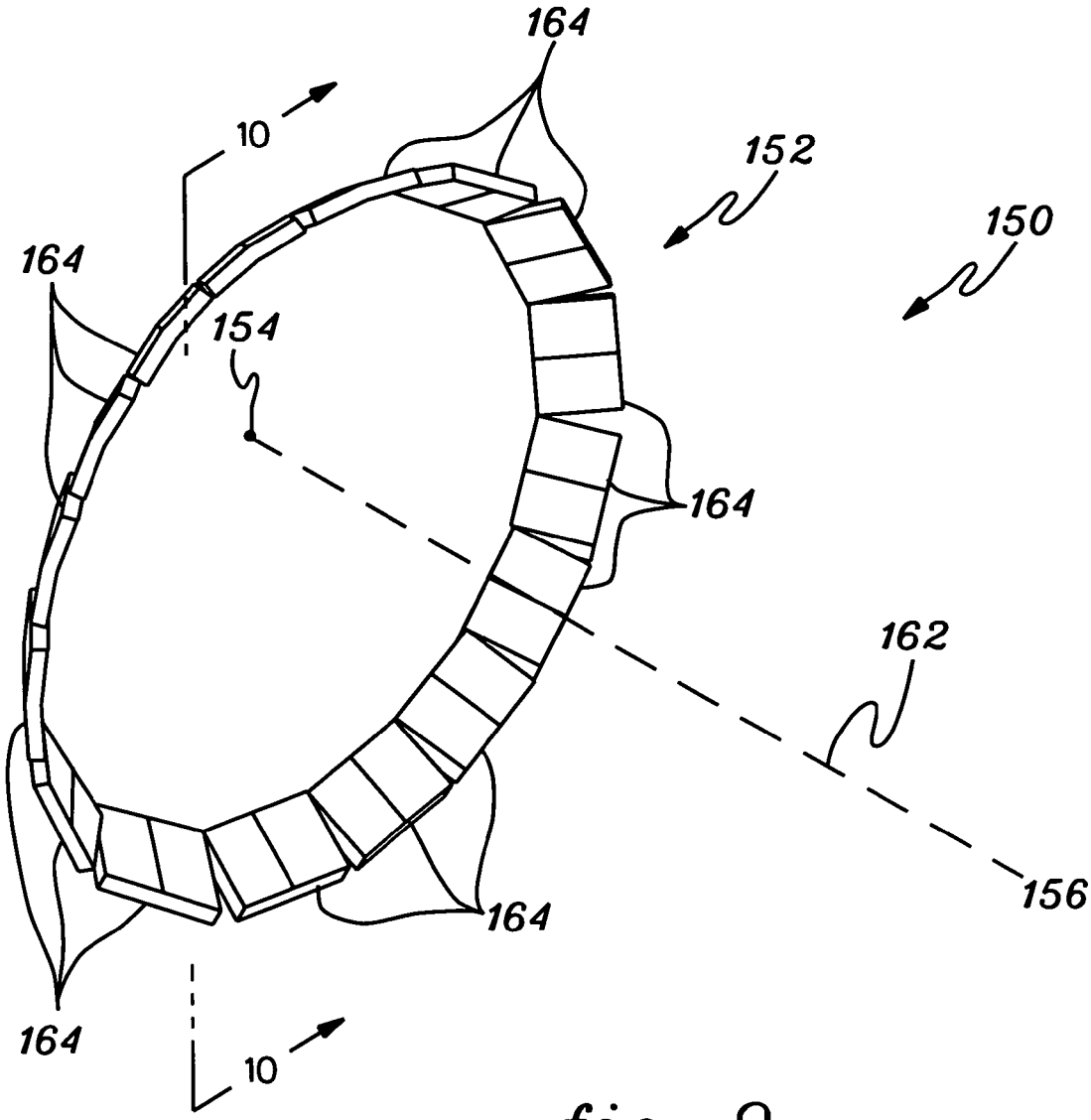
FIG. 9 of an arrangement of optic crystals and the arrangement's corresponding Rowland circle geometry according to one aspect of the present invention.
Figure 10:
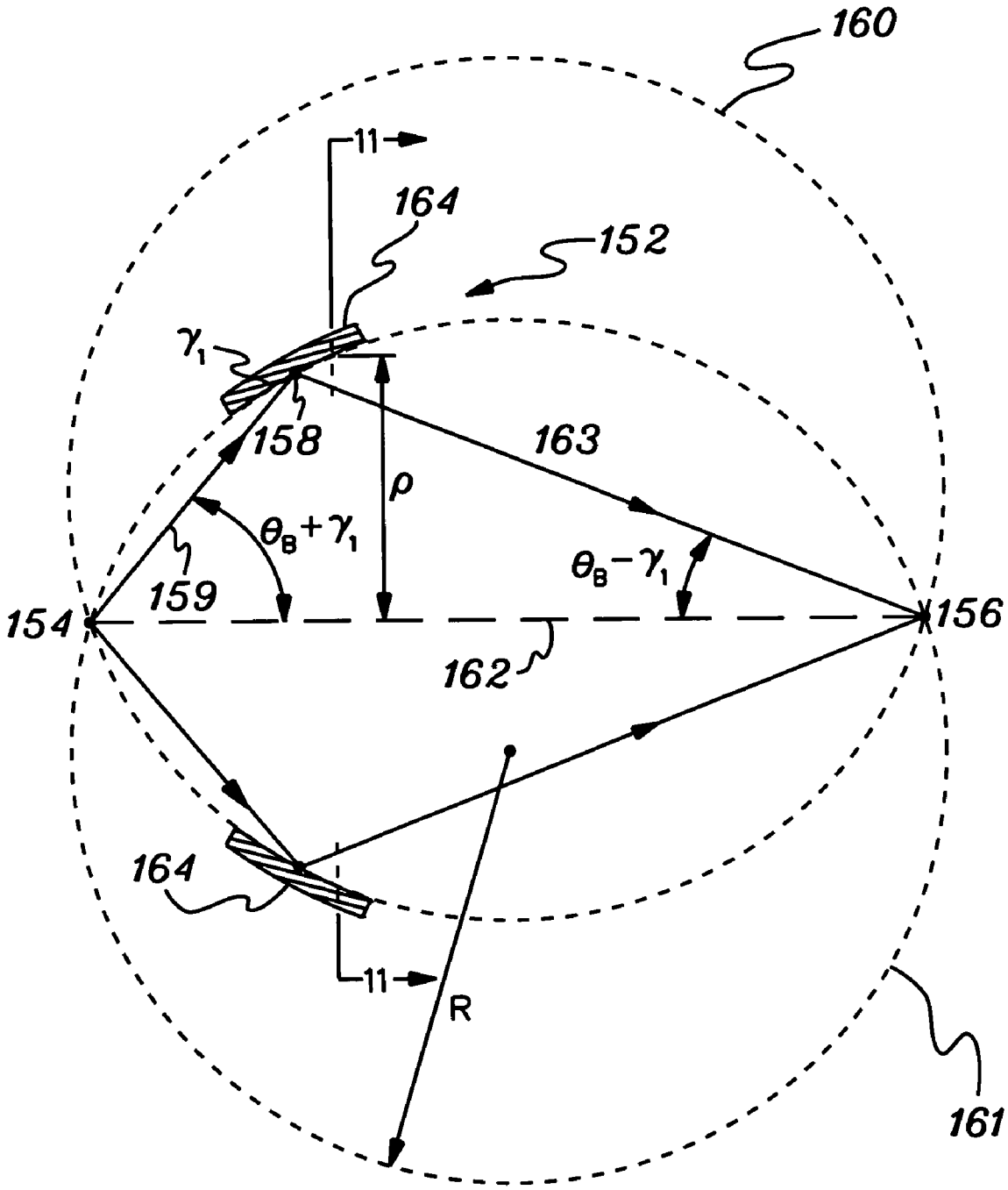
FIG. 10 is a cross-sectional view of the arrangement of optic crystals shown in FIG. 9 as viewed along view lines 10—10 in FIG. 9 according to one aspect of the present invention.
Figure 11:
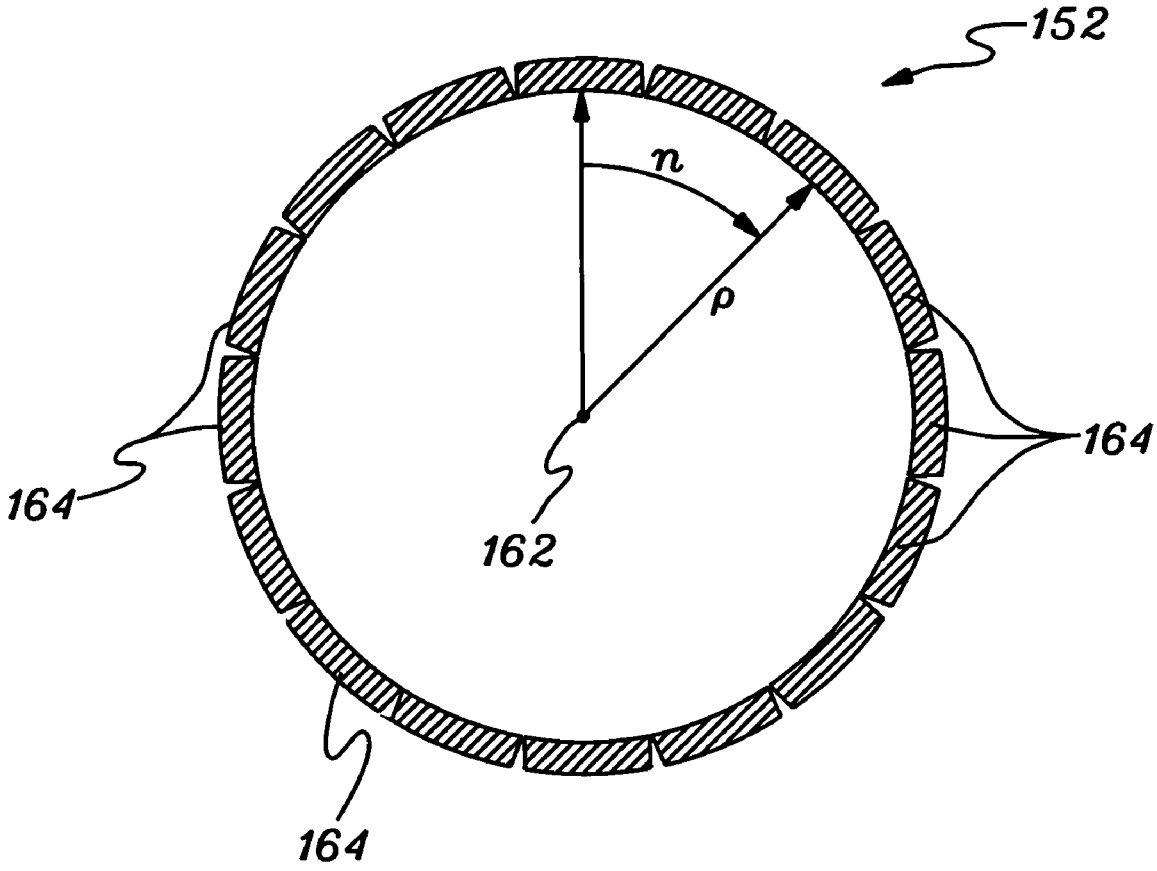
FIG. 11 is a cross-sectional view of the arrangement of optic crystals shown in FIG. 9 as viewed along view lines 11—11 in FIG. 10 according to one aspect of the present invention.

Another aspect of the present invention is illustrated in FIGS. 9, 10 and 11. FIG. 9 is a representative isometric view of an x-ray focusing arrangement 150 having a curved optic crystal 152, an x-ray source location 154, and an x-ray target location 156, which define a Rowland circle 155. X-ray source location 154 and x-ray target location 156 define a source-to-target line 162. In one aspect of the invention, optic crystal 152 is axi-symmetric about source-to-target line 162. According to this aspect of the invention, optic crystal 152 may include at least one optic crystal 164, and typically may include a plurality of individual optic crystals 164. Optic crystal 152 may have an arc length about source-to-target line 162 of at least about 45 degrees, typically, at least 90 degrees, and can be at least 180 degrees. For example, in the embodiment of this aspect of the invention shown in FIG. 9, optic crystal 152 comprises an arc length of about 360 degrees, that is, optic 152 comprises essentially a complete circle. Again, the one or more optic crystals 164 are typically one or more doubly-curved optic crystals. Also, optic 152 may be mounted in a support frame which is again not shown for ease of illustration.

FIG. 10 is a cross-sectional view taken along section lines 10—10 shown in FIG. 9. FIG. 11 illustrates a cross section of the crystal optic 152 as viewed through section 11—11 shown in FIG. 10. X-ray source location 154, x-ray target location 156, and source-to-target line 162 shown in FIG. 9 also appear in FIG. 10. As shown in FIG. 10, according to one aspect of the invention, the surface of optic 152, x-ray source location 154, and x-ray target location 156 define one or more Rowland (or focal) circles 160 and 161 of radius R for optic crystal 152. Those of skill in the art will recognize that the number and orientation of the Rowland circles associated with crystal optic 152, or individual crystals 164, will vary with the position of the surface of optic crystal 152, for example, the variation of the toroidal position on optic crystal 152, and that Rowland circles 160 and 162 are only representative of two of many similar circles associated with crystal optic 152. According to one aspect of the invention, focal circles 160 and 161 may be concentric and have the same focal radius R. In another aspect of the invention, as shown in FIG. 10, focal circles 160 and 161 may not be concentric, but have the same focal radius R. According to another aspect of the invention, the focal radii of optic circles 160, 161, and others may vary.

According to one aspect of the invention shown in FIGS. 9 and 10, the internal atomic diffraction planes of optic crystal 152 are not parallel to the surface of optic crystal 152 wherein the Bragg diffraction provides optimized focusing of x-rays on target location 156. For example, as shown in FIG. 10, the atomic diffraction planes of crystal 152 make an angle $\gamma_1$ with the surface of the crystal optic 152 upon which x-rays are directed. According to one aspect of the invention, the atomic diffraction planes of crystal 152 make an angle $\gamma_1$ with the surface of the crystal at the point of tangency of the surface of the crystal optic 152 and its corresponding optic circle 161 or 162. For example, as shown in FIG. 10, the point of tangency of optic circle 161 and crystal optic 152 is identified as point 158, which may be the geometric midpoint of the surface of crystal optic 152. As shown in FIG. 10, x-ray source location 154, point of tangency 158, and x-ray target location 156 define the Rowland circle 161 of radius R and x-ray source location 154 and x-ray target location 156 define the source-to-image line 162. Again, $\theta_B$ is the Bragg angle for crystal optic 152. Again, though optic 152 may comprise a single crystal, optic 152 typically comprises a plurality of individual crystals 164, for example, 2 or more. Each crystal 164 may be essentially identical, for example, identical to crystal 124 in FIGS. 3 and 4. In one aspect of the invention, when optic 152 comprises a plurality of individual crystals 164, the angle of the atomic diffraction planes, $\gamma_1$, in each crystal 164 are oriented to satisfy Bragg diffraction conditions, typically to optimize the transmission of x-ray energy to target location 156.

According to one aspect of the invention, as shown in FIG. 10, crystal optic 152 is fashioned wherein a line 159 from source location 154 and point 158 on the surface of crystal optic 152 makes and angle of about $\theta_B+\gamma_1$ with respect to source-to-image line 162. This angular relationship between the source location 154, target location 156, and crystal optic 152 satisfies the Bragg conditions for the atomic diffraction planes of optic 152 wherein the transmission of x-ray radiation from source location 154 to target location is optimized, for example, maximized. Correspondingly, the line 163 directed from target location 165 to point 158 makes an angle $\theta_B-\gamma_1$ with source-to-target line 162. In one aspect of the invention, this angular relationship applies to the entire surface of crystal optic 152 to which x-rays are exposed; however, according to one aspect of the invention, optic crystal 152 is fashioned wherein this relationship holds for at least one point on the surface of optic crystal 152. According to one aspect of the invention, optic crystal 152 is fashioned wherein this relationship applies to at least one of the individual optic crystals 164 from which crystal optic 152 is fashioned, typically, it holds for a plurality of optic crystals 164 from which crystal optic 152 is fashioned.

According to one aspect of the invention, the arrangement of individual crystals 164 shown in FIGS. 10 and 11 provides full coverage in a plane orthogonal to source-to-image connecting line 162. In one aspect of the invention, crystals 164 have a common bending radius D which in one aspect of the invention is selected to provide point-to-point focusing properties. Though the aspect of the invention shown in FIGS. 10 and 11 comprises a complete circular optic 152, in one aspect of the invention, the optic 152 is less than a complete circle. For example, in one aspect of the invention, the circumferential arc length $\eta$ (see FIG. 11) of optic 152 is at least about 45 degrees. In another aspect of the invention arc length $\eta$ may be at least 90 degrees, or at least 180 degrees.

According to one aspect of the invention, optic crystal 152 is fabricated so it is easily handled during manufacture, for example, during manufacture using the process outlined in U.S. Pat. No. 6,317,483 (the disclosure of which is incorporated by reference herein). According to one aspect of the invention, the radius D of optic crystal 152 varies along the axis of optic crystal 52, for example, along source-to-image line 152, wherein optic crystal can be more readily removed from the mold from which it is manufactured.

In addition to providing optimum x-ray collection, crystal 152 can be fabricated without destroying the tooling when removing crystal 152 from a mold, for example, in a fashion similar to the method disclosed in U.S. Pat. No. 6,285,506, entitled "Curved Optical Device and Method of Fabrication".

Figure 12:
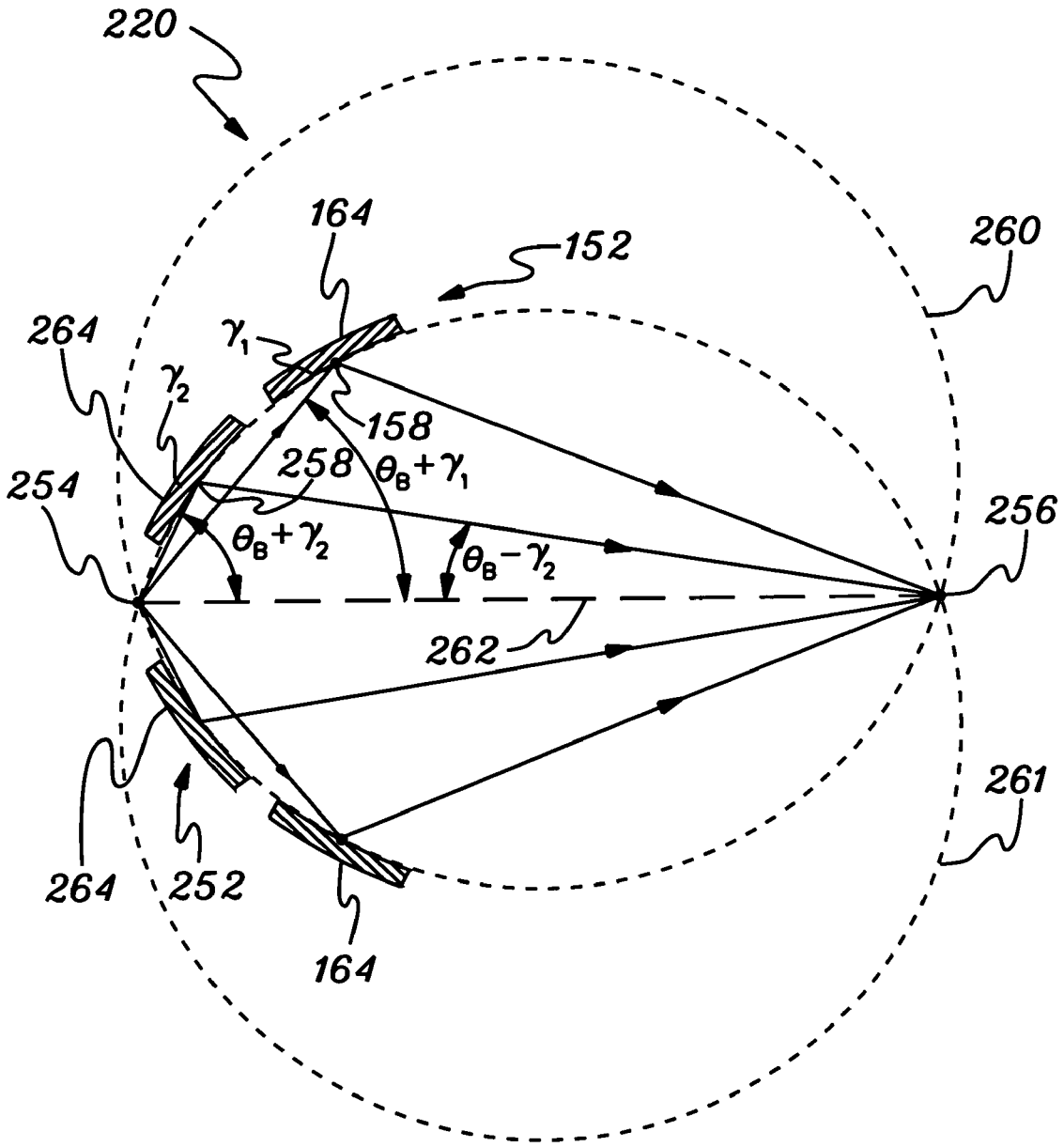
FIG. 12 is a cross-sectional view, similar to FIG. 10, of an arrangement of optic crystals having two concentric sets of crystals according to one aspect of the present invention.

FIG. 12 is a cross-sectional view similar to the cross-sectional view shown in FIG. 10 of another aspect of the present invention. According to one aspect of the invention, two or more crystal optics are used to capture x-rays, for example, from a common source, and direct them to a common target. FIG. 12 illustrates a cross-sectional view of x-ray optic arrangement 220, having an x-ray source location 254, an x-ray target location 256, an source-to-image line 262, and optic circles 260 and 261. According to one aspect of the invention, arrangement 220 includes at least one optic crystal 152, that is, a crystal optic 152 as shown in FIGS. 9 through 11, and a second crystal optic 252. Crystal optic 252 may be similar to crystal optic 152, for example, crystal optic 252 may have one or more of the physical attributes of crystal optic shown and described with respect to FIGS. 9 through 11, but crystal optic 252 may be smaller or larger in diameter than crystal optic 152. According to one aspect of the invention where crystal optic 152 comprises one or more individual crystal optics 164 having atomic diffraction planes at an angle (1, crystal optic 252 comprises one or more individual crystal optics 264 having atomic diffraction planes at an angle (2, that is, at an angle different from $\gamma_1$. Crystal optics 152 and 252 may have similar or different Bragg angles $\theta_B$. According to one aspect of the invention crystal optics 158 and 258 provide point focusing, for example, point-to-point focusing, of x-rays on target location 256. According to one aspect of the invention, optic crystals 152 and 252 are fashioned wherein lines drawn from source location 254 to points on their respective surfaces, for example, points 158 and 258 shown in FIG. 12, make angles $\theta_B+\gamma_1$ and $\theta_B+\gamma_2$, respectively, with source-to-image line 262. Again, in one aspect of the invention, the points 158 and 258 may be the midpoints of the surfaces of crystal optics 152 and 252, or points 158 and 258 may correspond to the point of tangency of the surfaces of crystal optics 152 and 252 and their respective optic circles 260 and 261. Again, as described with respect to crystal optic 152, crystal optics, 152 and 252 may comprise complete circular optics; however, in one aspect of the invention, the crystal optics 152 and 252 may be less than a complete circle. For example, in one aspect of the invention, the circumferential arc length $\eta$ (see FIG. 11) of optics 152 and 252 may be at least about 45 degrees. In another aspect of the invention arc length $\eta$ may be at least 90 degrees, or at least 180 degrees.

EXAMPLES

One or more aspects of the present invention are exemplified by the following examples. One specific example of an optic fabricated according to the aspect of the invention shown in FIGS. 3 and 4 is a Germanium (Ge) crystal optic for focusing Chromium (Cr) K$\alpha$ radiation. The Ge crystal fabricated according to the present invention included reflection crystal planes Ge(111) and a Bragg angle for Cr Ka radiation of about 20.5°. According to one aspect of the invention, five Ge crystals pieces with inclined atomic diffraction planes of Ge(111) of −8 degrees, −4 degrees, $\eta$ degrees, 4 degrees, and 8 degrees respectively were used. The Ge crystal device provided point focusing CrK$\alpha$ beam with a collection solid angle of 0.1 sr. for a 50° revolving angle, $\phi$, see FIG. 1. This optic according to this aspect of the invention produced an x-ray image of about $3\times10^{10}$ photons/sec at the target location using a 50 Watt, point x-ray source with Cr anode. This intense x-ray beam according to this aspect of the invention can have important applications, for example, in high sensitivity XRF analysis for measuring low Z elements.

An example of the aspect of the invention shown in FIGS. 9, 10, and 11 was fabricated from Silicon (Si) crystal for focusing Molybdenum (Mo) K$\alpha$ radiation. In this aspect of the invention, the atomic reflection crystal planes were Si(220) and the Bragg angle was about 10.6°. The inclined angle of Si(220) was about 1 degree for 16 pieces of crystals that were formed into a ring. The Si optic according to this aspect of the invention had a collection solid angle of about 0.04 sr. and provided about $1\times10^9$ Mo K$\alpha$ photons/sec at the target focal spot. This extremely intense x-ray beam according to this aspect of the invention can be used, for example, for high speed or high sensitivity monochromatic XRF applications.

The crystal optics disclosed in FIGS. 3–12 are applicable for use with any kind of x-ray sources, for example, x-ray tubes or synchrotrons. The optics disclosed in FIGS. 3–1 may provide point focusing, for example, point-to-point focusing, line-focusing, for example, point-to-line focusing, or any other type of image focusing depending upon the shape of image desired by the operator. However, regardless of the shape of the source or shape of the focused image, in one aspect of the invention, due to the increased capturing and focusing of x-ray energy by the optics according to the present invention, the x-ray sources can typically consume less power than conventional x-ray sources while still providing sufficient energy flux to the target for many applications. For example, one aspect of the inventions disclosed in FIGS. 5–13 can be used with x-ray sources which consume less than 100 Watts of power during operation. In other aspects of these inventions, the x-ray source can consume less than 50 Watts, less than 25 Watts, or even less than 10 Watts and still provide sufficient energy flux to the target.

The present invention provides devices that can be used to dramatically improve the utilization of x-rays in a myriad of analytical and research applications, by among other things, increasing the radiation beam collection angle compared to the prior art. This increased utilization of x-ray beam energy according to the present invention provides the potential to reduce the size of high-energy radiation focusing systems while also reducing required measuring or exposure times in experimental and industrial processes.

While the invention has been particularly shown and described with reference to preferred embodiment, it will be understood by those skilled in the art that various changes in form and details may be made to the invention without departing from the spirit and scope of the invention described in the following claims.

What is claimed is:

1. An optical device for directing x-rays, the optical device comprising:

a plurality of curved optical crystals, each with at least one lattice plane, positioned according to an x-ray source and an x-ray target to define at least one Rowland circle of radius R and a source-to-target line;

wherein the optical device provides focusing of x-rays from the source to the target;

wherein the plurality of curved optical crystals have a radius at the plane of the Rowland circle different than R; and wherein an angle of at least one lattice plane of a first crystal of the plurality of curved optical crystals relative to a surface of the first crystal is different from an angle of at least one lattice plane of a second crystal of the plurality of curved optical crystals relative to surface of the least one second crystal.

2. The optical device of claim 1, wherein the plurality of curved optical crystals have a radius at the plane of the Rowland circle of about 2R.

3. The optical device of claim 2, wherein at least one of the plurality of optical crystals comprises a surface upon which x-rays are directed, and wherein at least one of the plurality of optical crystals comprises a set of atomic diffraction planes having a Bragg angle $\theta_B$ and oriented at an angle $\gamma$ with the surface of the at least one of the plurality of optical crystals, and wherein a line drawn from the x-ray source to a point on the surface of the at least one of the plurality of optical crystals makes an angle $\theta_B+\gamma$ with the source-to-target line.

4. The optical device of claim 3, wherein the line drawn from the x-ray source to a point on the surface of the at least one of the plurality of optical crystals comprises a line drawn from the x-ray source to the midpoint of the surface of the at least one of the plurality of optical crystals.

5. The optical device of claim 3, wherein the line drawn from the x-ray source to a point on the surface of the at least one of the plurality of optical crystals comprises a line drawn from the x-ray source to about the point of tangency of the surface of the at least one of the plurality of optical crystals and the Rowland circle of the at least one of the plurality of optical crystals.

6. The optical device of claim 1, wherein at least one of the crystals is a doubly-curved crystal.

7. The optical device of claim 6, wherein at least one of the crystals is a toroidal doubly-curved crystal.

8. The optical device of claim 1, in combination with a source of x-rays.

9. The optical device of claim 1, wherein the optical device comprises a toroidal angle about the source-to-target line of at least about 90 degrees.

10. The optical device of claim 9, wherein the optical device comprises a toroidal angle about the source-to-target line of at least about 180 degrees.

11. The optical device of claim 10, wherein the optical device comprises a toroidal angle about the source-to-target line of at least about 270 degrees.

12. The optical device of claim 11, wherein the optical device comprises a toroidal angle about the source-to-target line of about 360 degrees.

13. The optical device of claim 1, wherein the angle of the lattice planes of the first crystal relative to the surface of the first crystal is about zero.

14. The optical device of claim 1, wherein the angle of the at least one lattice plane of the at least one second crystal relative to the surface of the at least one second crystal is at least about 5 degrees greater than the angle of the at least one lattice plane of the first crystal relative to the surface of the first crystal.

15. The optical device of claim 1, wherein a line directed from the x-ray source to the center of a surface of the first curved crystal and a line directed from the x-ray source to the center of a surface of the at least one second crystal define an angle $\gamma$.

16. The optical device of claim 15, wherein the angle of the at least one lattice plane of the at least one second crystal relative to the surface of the at least one second crystal is about $\gamma$.

17. The optical device of claim 1, wherein the angle $\gamma$ is between about minus 15 degrees and about plus 15 degrees.

18. A method for directing x-rays, comprising:

providing an optical device, the optical device comprising a plurality of curved optical crystals, each with at least one lattice plane, arranged in a matrix, the matrix being positionable to define at least one Rowland circle of radius R with an x-ray source and an x-ray target, and wherein the matrix comprises a plurality of rows, with each row comprising multiple optical crystals of said plurality of optical crystals, wherein the plurality of curved optical crystals have a radius at the plane of the Rowland circle different than R; and positioning the optical device wherein at least some x-rays from the x-ray source are directed to the x-ray target;

wherein an angle of at least one lattice plane of a first crystal of the plurality of curved optical crystals relative to a surface of the first crystal is different from an angle of at least one lattice plane of a second crystal of the plurality of curved optical crystals relative to a surface of the at least one second crystal.

19. The method of claim 18, wherein the plurality of curved optical crystals have a radius at the plane of the Rowland circle of about 2R.

20. The method of claim 18, wherein positioning the optical device comprises positioning the device wherein at least some x-rays emitted by the source impinge at least some of the crystals of the optical device wherein at least some of the x-rays are diffracted.

21. A device for directing x-rays, comprising a first curved crystal and at least one second curved crystal spaced from the first crystal, the first and at least one second curved crystal each comprising at least one lattice plane, and the first curved crystal and the at least one second curved crystal being positionable to define at least one Rowland circle of radius R with an x-ray source and an x-ray target, wherein at least some x-rays impinging upon the first curved crystal and the at least one second curved crystal are directed to the target, and wherein an angle of the at least one lattice plane of the first crystal relative to a surface of the first crystal is different from an angle of the at least one lattice plane of the at least one second crystal relative to a surface of the at least one second crystal.

22. The device of claim 21, wherein the angle of the lattice planes of the first crystal relative to the surface of the first crystal is about zero.

23. The device of claim 21, wherein the angle of the at least one lattice plane of the at least one second crystal relative to the surface of the at least one second crystal is at least about 5 degrees greater than the angle of the at least one lattice plane of the first crystal relative to the surface of the first crystal.

24. The device of claim 21, wherein a line directed from the x-ray source to the center of a surface of the first curved crystal and a line directed from the x-ray source to the center of a surface of the at least one second crystal define an angle $\gamma$.

25. The device of claim 24, wherein the angle of the at least one lattice plane of the at least one second crystal relative to the surface of the at least one second crystal is about $\gamma$.

26. The device of claim 25, wherein the angle $\gamma$ is between about minus 15 degrees and about plus 15 degrees.

27. The device of claim 21, wherein the first curved crystal and the at least one second crystal comprise a first set of crystals, and the device further comprises at least one second set of crystals which are also positioned to define a Rowland circle with the x-ray source and the x-ray target, wherein at least some x-rays which impinge upon the at least one second set of crystals are directed to the x-ray target, the target being common with the first set of crystals, and wherein the second set of crystals is spaced from the first set of crystals in a direction orthogonal to a plane of the Rowland circle of the first set of crystals.

* * * * *

UNITED STATES PATENT AND TRADEMARK OFFICE

CERTIFICATE OF CORRECTION

PATENT NO. : 7,035,374 B2
APPLICATION NO. : 11/048146
DATED : April 25, 2006
INVENTOR(S) : Chen It is certified that error appears in the above-identified patent and that said Letters Patent is hereby corrected as shown below:

Claims:

Claim 1

Col. 16, line 39, insert the word --a-- after the word "to"

Col. 16, line 29, insert the word --at-- after the word "the"

Signed and Sealed this

Twenty-second Day of August, 2006

JON W. DUDAS
*Director of the United States Patent and Trademark Office*